United States Patent [19]

Diermayer et al.

[11] Patent Number: 4,838,481

[45] Date of Patent: Jun. 13, 1989

[54] DRAFT CONTROL ARRANGEMENT FOR VENTING OF COMBUSTION APPARATUS

[76] Inventors: Werner Diermayer, 1275 Panorama Dr., Lafayette, Calif. 94549; Luitpold Kutzner, Bosettistr. 8, 8000 München 60, Fed. Rep. of Germany

[21] Appl. No.: 188,263

[22] Filed: Apr. 29, 1988

[30] Foreign Application Priority Data

May 12, 1987 [DE] Fed. Rep. of Germany ..... 3715855

[51] Int. Cl.[4] ..... G05D 23/00

[52] U.S. Cl. ..... 236/1 G; 126/285 R; 236/93 R; 236/101 E; 251/305; 403/348

[58] Field of Search ..... 236/93 R, 101 E, 101 R, 236/1 G; 403/119, 348, 349, 353; 126/285 R, 292; 251/228, 235, 305

[56] References Cited

U.S. PATENT DOCUMENTS

| | | | |
|---|---|---|---|
| 1,595,959 | 8/1926 | Barrows | 236/101 R |
| 1,731,214 | 10/1929 | Eshbaugh | 236/93 R X |
| 1,761,946 | 6/1930 | Wedin | 236/93 R |
| 2,257,972 | 10/1941 | McCollum | 236/101 E |
| 2,677,501 | 5/1954 | Raymond et al. | 236/93 R |
| 3,659,884 | 5/1972 | Ohlin | 403/348 X |
| 4,245,783 | 1/1981 | Richter | 236/101 E X |

FOREIGN PATENT DOCUMENTS

| | | | |
|---|---|---|---|
| 3242834 | 1/1987 | Fed. Rep. of Germany | 236/101 R |
| 698688 | 10/1929 | France | 236/93 R |

*Primary Examiner*—William E. Tapolcai
*Attorney, Agent, or Firm*—Flehr, Hohbach, Test, Albritton & Herbert

[57] ABSTRACT

In a bimetal-actuated damper a loop-shaped bimetal element engages a damper element. One end of the loop is fixedly fastened while the other end of the loop is movably connected with the damper element. This improves temperature-dependent response and sensitivity of the damper and prevents damage from overheating or permanent change of operating characteristics.

18 Claims, 3 Drawing Sheets

DRAFT CONTROL ARRANGEMENT FOR VENTING OF COMBUSTION APPARATUS

Vented, gas-fired appliance relying on natural draft for the removal of products of combustion are equipped with a draft hood which isolates the combustion chamber from excessive updraft or backdraft in the vent. The conduit between the draft hood relief opening and the outside is permanently open and therefore causes heat loss, especially during cold and windy weather.

For energy conservation it is desirable that the airflow in the vent always be restricted to the safe minimum. During the standby phase of the appliance the safe minimum is a sufficient air flow to remove the vent gases of the pilot flame, if so equipped, and to provide some air change in the vent to prevent excess condensation. During the operating phase the safe minimum is a sufficient air flow to remove the products of combustion while retaining heated room air, regardless of the varying draft in the vent.

Thermally actuated vent dampers, designed with the above ideal performance in mind, are known. When the main burner of the applicance is turned on products of combustion rise to the damper while it is still essentially closed and a part of the products of combustion escape temporarily through the draft hood relief opening. Since this spillage of products of combustion is undesirable, one main objective of thermal vent damper design is a quick opening upon the start of main burner operation.

In recent years the efficiency of gas-fired appliances has been raised. More heat is being transferred from the burner to the medium to be heated resulting in lower vent gas temperatures which in turn requires new thermal vent damper designs aimed at being closed at temperatures normally prevailing during standby (e.g. up to 50° C.) for energy conservation, but quickly opening at a temperature of e.g. 65° C.

During continued operation of the appliance the vent gas temperature at the damper may rise to e.g. 90° C. at low flame (in variable-output appliances) and e.g. 150° C. at full flame. In addition, a safety margin must be provided for temperatures of e.g. 300° C. which may occur as a result of malfunction in, or maladjustment of, the appliance. The temperature-sensitive actuating element of the vent damper, in addition to opening the damper in a narrow temperature range of e.g. between 50° C. and 65° C. must be designed to withstand the stress of the exposure to the additional rise of temperature of e.g. up to 300° C.

Thermally actuated vent dampers manufactured according to prior designs cannot meet the stringent requirements to be closed at 50° C., to be essentially open at 65° C., to withstand repeated temperature overloads of up to 300° C. and to maintain their operating characteristics during their lifetime. The vent damper described in this invention is able to perform within the above-listed specifications through a combination of a damper element having a knife-edge support and a bimetal strip shaped in form of a loop with one of its ends fastened to a fixed bracket and its other end movably connected to the damper element.

The foregoing and other features and objects of the invention will be described in more detail in the following specification and drawings in which.

Figure 1:
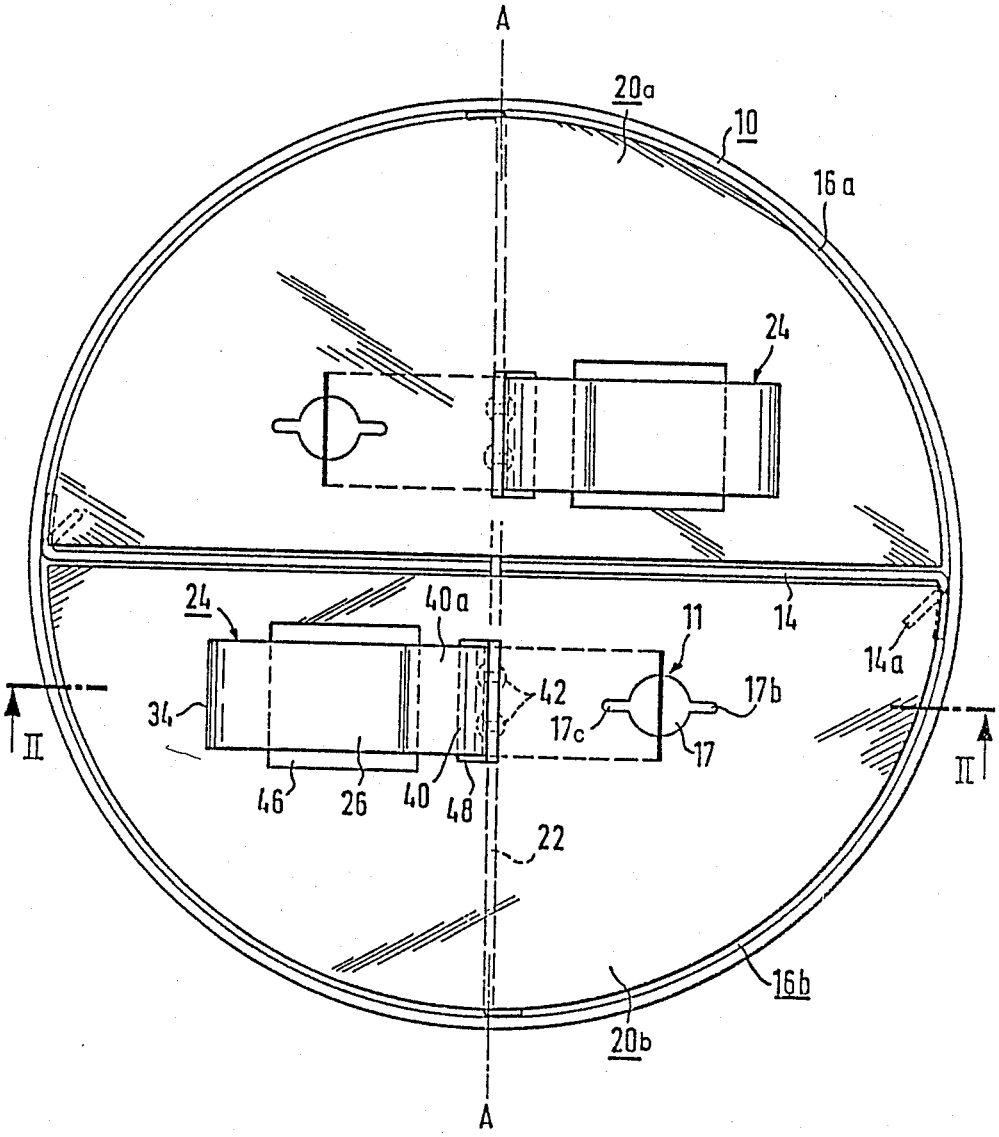
FIG. 1 is a plan view of the damper according to a preferred embodiment of the invention.
Figure 2:
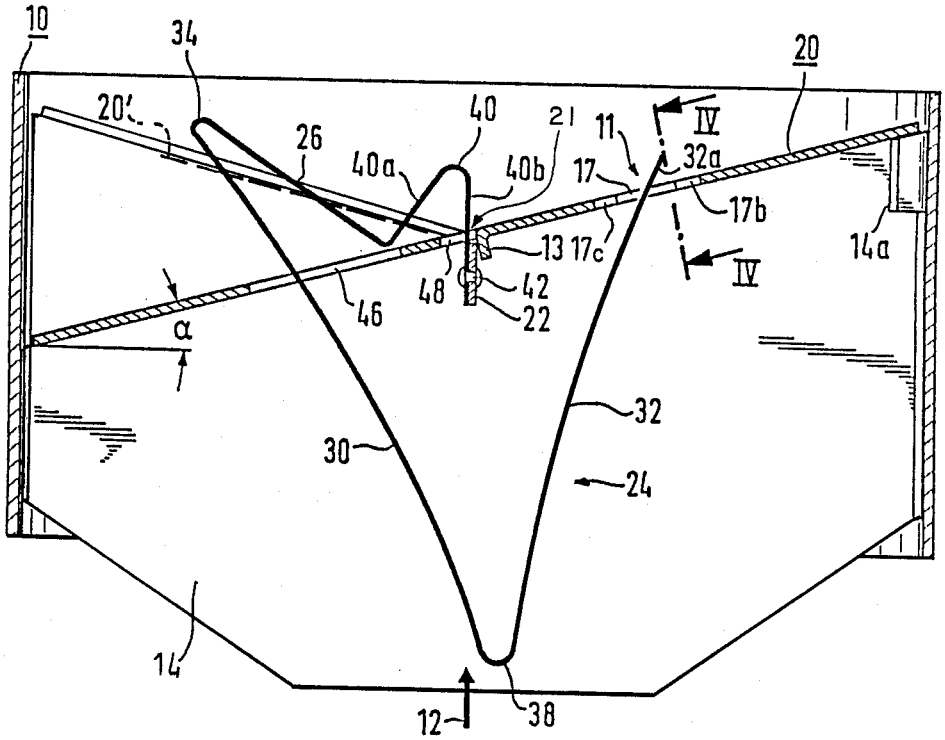
FIG. 2 is a section along line II—II of FIG. 1 with the damper in the cold state (closed position).
Figure 4:
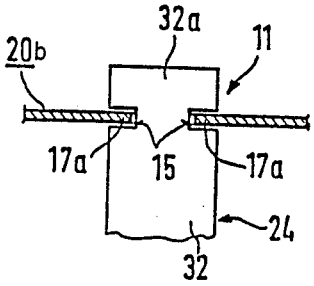
FIG. 4 shows a partial section along line IV—IV of FIG. 2.

In FIGS. 1 and 2 the cylindrical housing 10 forms a part of the vent through which the vent gases flow. Arrow 12 in FIG. 2 indicates the direction of the gas flow which is parallel to the central axis of housing 10. As shown in FIG. 1, housing 10 is divided by a partition 14 into two ducts 16*a* and 16*b*. Semicircular, essentially flat damper elements 20*a* and 20*b* are positioned in a respective one of the ducts 16*a* and 16*b*. In FIG. 2 the damper element 20 is shown at its fully closed position in which it assumes an angle $\alpha$ of approximately 15° from a plane perpendicular to the housing central axis. The partition is crossed by a support bracket 22, and damper elements 20*a*, 20*b* are mounted on bracket 22 to swing around axis A—A. As shown in FIG. 2 the damper element, in the cold state, rests on stop 14*a* formed by a lug of partition 14.

A bimetal element, indicated generally as 24, supports damper element 20*b* and provides for its temperaturedependent actuation. The bimetal element comprises a half-base 26 and two sides 30 and 32 of the triangle. Between half-base 26 and side 30 of the triangle is a rounded corner 34. An additional rounded corner 38 is located between sides 30 and 32 of the triangle. The half-base 26 is riveted 42 via a U-loop 40 to bracket 22. One leg 40*a* of the U-loop 40 continues to half-base 26, while the other leg 40*b* is riveted to support bracket 22. The second side 32 of the triangle is pivotally connected with damper element 20 at a knife-edge connection 11.

The damper elements 20*a* and 20*b* and their associated parts are similar in construction and operation and it will suffice to explain in detail the element 20*b*. Damper element 20*b* has a rectangular opening 46 through which a part of bimetal element 24 protrudes so that half-base 26 and corner 34 lie above damper element 20*b*. A slot 48 is provided through which leg 40*b* of the U-loop protrudes in such a manner that a pivot line 21 is formed at the upper edge of support bracket 22 that secures damper element 20*b* against shifting lengthwise. The width of slot 48 is commensurate with the width of bimetal element 24 so that element 24 holds damper element 20*b* in position against lateral displacement. Slot 48 in the longitudinal direction of damper element 20*b* is sufficiently wide to allow a swiveling movement of 60° to 70°. A bend 13 of the damper element 20*b* forms a stop which can move against support bracket 22.

FIG. 2 shows the bimetal element 24 in a cold state in which the element is under internal prestress which is maintained by damper element 20*b* pressing against stop 14*a*.

Bimetal element 24 is formed by a bimetal strip, approximately 1.5 cm wide, with the layer having the higher coefficient of expansion (the active layer) at the outer side of the triangle.

As shown in FIG. 2 partition 14 protrudes below the lower edge of housing 10 so that the partition protects bimetal element 24 in areas where it extends below housing 10. The lower contour of partition 14 is shaped in such a manner that - regardless how the damper is placed on a table - the extending parts of the bimetal elements do not touch the table. Damper element 20 also lies, in all its possible positions, within the protective area formed by partition 14. When the damper is installed in a vent containing any obstacle the partition will touch such obstacles first, thereby preventing damage to, and assuring free movement of, bimetal elements 24 and damper elements 20.

Partition 14 also performs a closing function that is necessary due to the opposite inclination of the damper elements 20 lying adjacent along axis A—A, according to FIG. 1. Without partition 14, large triangular gaps would remain between the two damper elements 20 through which room air would escape unimpeded during the cold state.

Figure 3:
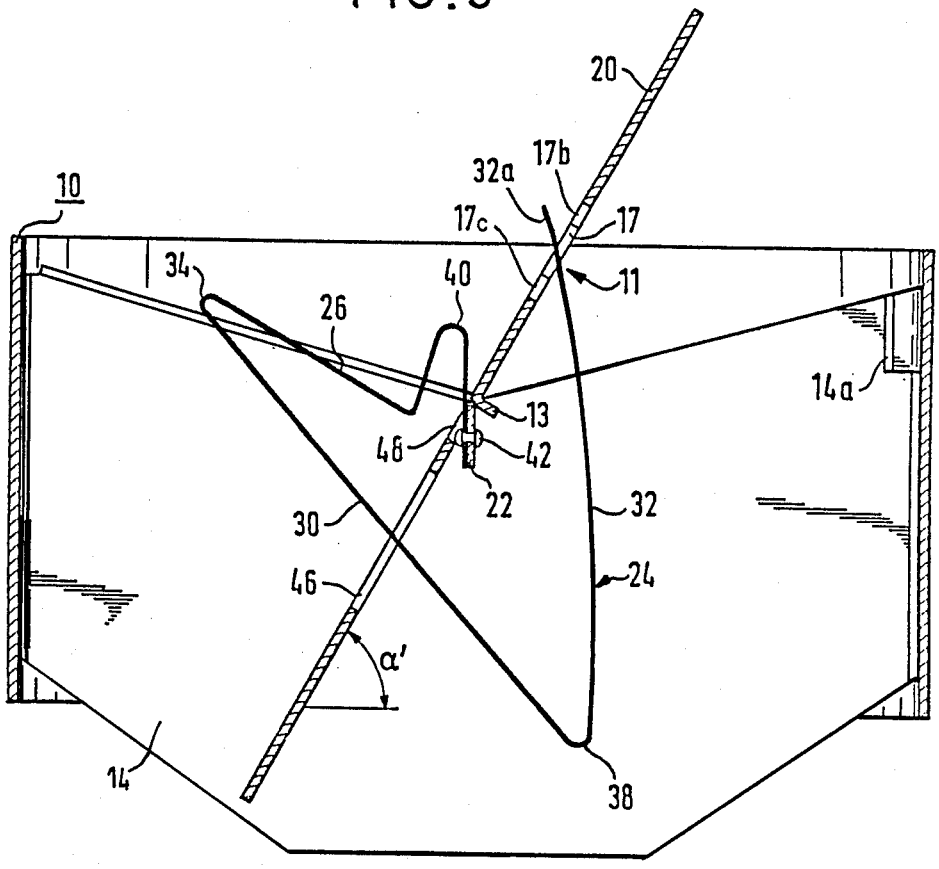
FIG. 3 is a section similar to FIG. 2 with the damper in fully open position.

When the appliance is started up and bimetal element 24 warms up the damper assumes the position shown in FIG. 3 whereby angle $\alpha$ is increased to $\alpha'$. The position according to FIG. 3 corresponds to a temperature increase of, e.g., 65° C. The damper is then essentially open. During a further increase in temperature, side 30 of the triangle passes from a bow toward the interior of the triangle, as shown in FIG. 2, to a nearly straight shape, while side 32 changes from a very slight bow toward the inside of the triangle to a slight bow toward the outside of the triangle.

In the embodiment of FIGS. 1–4 connecting point 11 is formed by notches 15 near the end 32*a* of side 32 of bimetal element 24. Slots 17*b* and 17*c* are formed at opposite sides of opening 17 at positions which are rotationally offset from the bimetal strip. During assembly, end 32*a* of bimetal element 24 is twisted so that it can be passed through slots 17*b* and *c* in opening 17. As the twisting force is released the notches 15 engage rim 17*a* of the opening 17.

Figure 5:
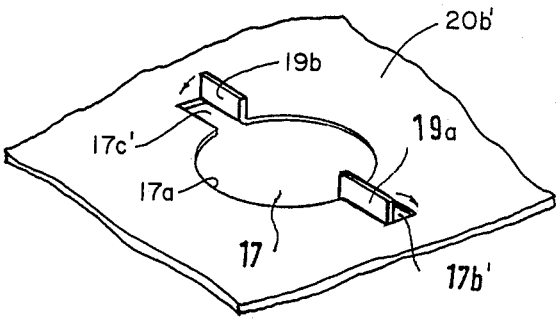
FIG. 5 shows a perspective view of a component part in a damper according to another embodiment of the invention.

In FIG. 5 an embodiment is shown which provides a modified connecting means which prevents unintended disengagement of the bimetal element from the damper element. In this embodiment, instead of punching out the slots shown in FIGS. 1–4, tabs 19*a* and 19*b* are formed from the material of the slots. After assembling damper element 20*b*′ and the bimetal element, these tabs are then bent back to their original position in the plane of damper element 20*b*. Thereby slots 17*b*′ and 17*c*′ are closed and an accidental disengagement between damper element 20*b*′ and the bimetal element is prevented.

We claim:

1. A thermally actuated damper unit for use in the vent of a heating apparatus, specifically a gas-fired heating appliance in which the damper, at increasing temperature, yields an increasng opening to the flow of vent cases, the damper unit comprising the combination of housing means forming a flow passage (10), flow control means comprising at least one damper element (20) swiveling at a stationary support (22) around a transverse axis (A—A), at least one thermally-actuated element (24) actuating the damper element (20), which at its one end is fixedly fastened at a stationary support (42) and at its other end (32*a*) engages damper element (20) at knife-edge connection (11), forming between its ends a strip shaped as a loop, the axis of the loop (26, 30, 32) being essentially parallel to axis A—A, the overall length of the loop being much greater than the distance between the two ends (40*b*, 32*a*), and the other end (32*a*) of loop (26, 30, 32) being pivotally connected at knife-edge connection (11), the axis of said pivotal connection being essentially parallel to axis A—A, at a distance from stationary support (42).

2. A damper according to claim 1 in which the element (24) is a bimetal loop (26, 30, 32) which describes an open polygon from the stationary support (42) to connection (11).

3. A damper according to claim 2 in which the bimetal layer having the greater coefficient of expansion is arranged at the outside of loop (26, 30, 32).

4. A damper according to claim 2 in which at least a part (30) of the sides (26, 30, 32) of the polygon, in the cold state, are curved convexly toward the interior of the polygon.

5. A damper according to claim 2 in which the polygon is a triangle and a first half (26) of the base of the triangle reaches from the stationary support (42) to the first corner (34) of the triangle, a first side (30) of the triangle and continuing to a second side (32) of the triangle, the free end (32*a*) of which is pivotally connected to the damper element 20 at the connection (11).

6. A damper according to claim 5 in which the half-base (26) is fixedly fastened to the stationary support (42) through an end-section (40) having a plurality of bends.

7. A damper according to claim 6 in which the end-section (40) having several bends forms a U shape open to the interior of the triangle, whose one leg (40*a*) forms approximately a right angle with the half-base (26) of the triangle and whose other leg (40*b*) is fixedly fastened to the stationary support (42).

8. A damper according to claim 7 in which damper element (20) is essentially flat, the second side (32) of the triangle and a part of the first side (30) of the triangle being arranged at the side of the damper element facing the heating apparatus while the remainder of the first side (30) of the triangle passing through a slot (46) of the damper element (20) and the half-base (26) of the triangle lie at the side of damper element (20) away from the heating apparatus.

9. A damper according to claim 1 in which the stationary support (42) substantially coincides with the pivot line (21).

10. A damper according to claim 9 in which the pivot line (21) of the damper element (20) is formed by a slotted seat (48) of damper element (20) through which bimetal element (24) passes near its end (40*b*) whereby damper element (20) in the areas of the slotted seat (48) rests on a stationary fastening bracket (22) of stationary support (42).

11. A damper according to claim 2 which includes a stop (14*a*) projecting inwardly from housing means (10) which defines the position that damper element (20) assumes in the cold state and thereby holds bimetal element (24) under internal prestressing.

12. A damper according to claim 2 in which the pivotal engagement at connection (11) is formed by interlocking parts of damper element (20) and the second end (32*a*) of bimetal element (24).

13. A damper according to claim 12 in which damper element (20) has an opening (17) through which the second end (32*a*) of bimetal element (24) protrudes, the longitudinal edges of the second end (32*a*) of bimetal element (24) having notches (15) engaging the edge of opening (17*a*).

14. A damper according to claim 13 in which slots (17*b*, 17*c*) are formed at the opposite sides of opening (17) at positions which are rotationally offset from the bimetal element (24) for insertion of the twisted end (32*a*) of bimetal element (24).

15. A damper according to claim 2 having a support bracket (22) and a pair of said damper elements (20), each element (20) having a bimetal element (24) installed in housing (10) on support bracket (22), the planes of the bimetal loops being parallel and the rotation of the damper elements (20) being in opposite direction.

16. A damper according to claim 15 having a partition (14) between the two damper elements (20) parallel to the center line (12) in the direction of flow within housing (10).

17. A damper according to claim 16 in which partition (14) projects, in the direction along the centerline of the housing, below the bimetal elements (24) in all their positions so that the bimetal element ends and the ends of the damper element (20) protruding from housing (10) are protected from touching other objects.

18. A thermally actuated damper unit for use in the vent of a heating apparatus, specifically a gas-fired heating appliance in which the damper, at increasing temperature, yields an increasing opening to the flow of vent cases, the damper unit comprising the combination of housing means forming a flow passage (10), flow control means comprising at least one damper element (20) swiveling at a stationary support (22) around a transverse axis (A—A), at least one thermally-actuated element (24) actuating the damper element (20), which at its one end is fixedly fastened at a stationarly support (42) and at its other end (32*a*) engages damper element (20) at knife-edge connection (11), forming between its ends a strip shaped as a loop, the axis of the loop (26, 30, 32) being essentially parallel to axis A—A, the overall length of the loop being much greater than the distance between the two ends (40*b*, 32*a*), the other end (32*a*) of loop (26, 30, 32) being pivotally connected at knife-edge connection (11), the axis of said pivotal connection being essentially parallel to axis A—A, at a distance from stationary support (42), said element (24) is a bimetal loop (26, 30, 32) which describes an open polygon from the stationary support (42) to knife-edge connection (11), said pivotal engagement at knife-edge connection (11) formed by interlocking parts of damper element (20) and the second end (32*a*) of bimetal element (24), said damper element (20) having an opening (17) through which the second end (32*a*) of bimetal element (24) protrudes, the longitudinal edges of the second end (32*a*) of bimetal element (24) having notches (15) engaging the edge of opening (17*a*), said slots (17*b*, 17*c*) formed at the opposite sides of opening (17) at positions which are rotationally offset from the bimetal element (24) for insertion of the twisted end (32*a*) of bimetal element (24), said material of slots (17*b*′) and (17*c*′) forming tabs (19*a*) and (19*b*) which are bent back to their original positions in the plane of damper element (20*b*′) to prevent disengagement of damper element (20*b*′) and bimetal element (24).

* * * * *